United States Patent [19]

Cerkovnik

[11] Patent Number: 4,515,227

[45] Date of Patent: May 7, 1985

[54] NOZZLE PLACEMENT IN A DIAMOND ROTATING BIT INCLUDING A PILOT BIT

[75] Inventor: Jerry Cerkovnik, Salt Lake City, Utah

[73] Assignee: Christensen, Inc., Salt Lake City, Utah

[21] Appl. No.: 489,197

[22] Filed: Apr. 27, 1983

[51] Int. Cl.[3] ..... E21B 10/60

[52] U.S. Cl. ..... 175/65; 175/385; 175/393

[58] Field of Search ..... 175/65, 67, 329, 339, 175/340, 385, 391, 392, 393, 418

[56] References Cited

U.S. PATENT DOCUMENTS

| | | | |
|---|---|---|---|
| 2,149,798 | 3/1939 | Starkey | 175/391 |
| 2,545,195 | 3/1951 | Crake | 175/393 X |
| 3,112,803 | 12/1963 | Rowley | 175/329 |
| 3,452,832 | 7/1969 | Ditson | 175/418 |
| 3,727,704 | 4/1973 | Abplanalp | 175/329 |
| 4,299,298 | 11/1981 | McEnery | 175/418 |

*Primary Examiner*—Stephen J. Novosad
*Assistant Examiner*—Michael Starinsky
*Attorney, Agent, or Firm*—Beehler, Pavitt, Siegemund, Jagger & Martella

[57] ABSTRACT

The flow of drilling fluid across the face of a rotating bit can be improved by disposition of jet nozzles in the middle of pads defined on the rotating bit rather than in or directly communicating with water courses in the bit. Drilling fluid is therefore ejected by the nozzle and flows in a plurality of directions across the face of the pad with a maximal velocity. Drilling fluid arriving in the proximity of the nozzle and provided from other sources in the bit is thus entrained within the drilling fluid which is ejected from the nozzle. This serves then to suction drilling fluid from these other sources. In particular, in a rotating bit having a pilot bit and main reamer bit, drilling fluid supplied to the pilot bit is directed toward a pilot bit junk slot in the immediate proximity of a nozzle disposed in the middle of a reamer lobe. Drilling fluid flowing down the pilot bit junk slot is entrained within drilling fluid ejected by the reamer nozzle. The combined fluid flows spread across the face of the reamer toward the main bit junk slots and gage broaches. Therefore, fluid is suctioned or drawn from and across the pilot bit by the reamer nozzles.

6 Claims, 3 Drawing Figures

NOZZLE PLACEMENT IN A DIAMOND ROTATING BIT INCLUDING A PILOT BIT

BACKGROUND OF THE INVENTION

1. Field of the Invention

The present invention relates to the field of earth boring tools and more particularly to rotating bits incorporating diamond cutting elements.

2. Description of the Prior Art

Diamond bits used for reaming operations are well known to the art and are generally characterized by a plurality of paths on a bit face of the rotating bit defined by alternating channels which serve as waterways and collectors for drilling mud pumped through openings defined in the bit face for the purposes of cooling and cleaning the bit. An example of such a diamond reaming bit is shown in Rowley, "COMBINATION DRILL AND REAMER BIT", U.S. Pat. No. 3,367,430. As exemplified by Rowley, such diamond bits are characterized by a generally central opening or crowfoot through which the drilling mud is provided to a plurality of waterways which radiate from the center of the bit face and outwardly across the face to the bit gage.

Diamond bits adapted for other applications have also been devised in which the central aperture or crowfoot has been replaced by a plurality of distributed nozzles such as shown by Rohde et al, "A DIAMOND DRILLING BIT FOR SOFT AND MEDIUM HARD FORMATIONS", U.S. Pat. No. 4,098,363. In the case of Rohde, the nozzles are positioned in a spiral array so that they form a plurality of substantially longitudinal arrays in each junk slot defined in the bit face. Within each junk slot, the array is more closely positioned to the leading edge of the junk slot where the diamond cutters are positioned than to the trailing edge of the next preceding blade portion or pad disposed on the opposite side of the junk slot. The nozzles are arranged in each longitudinal array so that the nozzles in each junk slot are spaced at substantially equal distances from the leading edge of the junk slot where the cutters are positioned. By this means, the drilling fluid is uniformly distributed across the junk slots and provided for flow over the adjacent pad.

It is also well known to devise a reaming diamond bit characterized by a main body portion and a pilot portion axially extending from the main body portion. The pilot bit first opens a smaller bore which is then enlarged or reamed by the main bit body which follows as the bit rotates and drills into the rock formation. An example of such a diamond reaming bit is shown in Crake, "DIAMOND BIT", U.S. Pat. No. 2,545,195. In the Crake bit, an axial nozzle is provided in the pilot bit to supply drilling fluid to a plurality of laterally extending waterways on the pilot bit. The drilling fluid moves radially along the radially directed waterways with a portion of the drilling fluid flowing over diamond elements on the adjacent pads. The fluid is then directed along junk slots and channels provided in the gage of the pilot bit toward the main bit body. At or near the connection of the main bit body with the pilot bit, a plurality of nozzles are positioned to provide additional drilling fluid to the continuation of the pilot bit waterways and junk slots which are continued on the face of the main bit.

The cleaning and cooling action of such reamers is substantially controlled by the fluid flow pattern defined by the channels, waterways, collectors and junk slots. Thus, the highest fluid velocities are obtained in such prior art bits within the fluid courses where the flow of drilling fluid is restricted. However, the cooling and cleaning action of the drilling mud is achieved only when the drilling fluid leaves the water courses and flows over the face of the bit or pads defined between the water courses. Thus the cooling and cleaning action of such prior art diamond bits is largely determined by the distribution of fluid which can be set up by the layout of water courses and is effected only to a lesser extent by fluid dynamics or pressure distributions across the bit face.

What is needed then is design for distributing fluid across a diamond rotating bit wherein distribution of drilling fluid exploits the dynamic characteristics of drilling fluid delivered to the bit face rather than primarily relying upon passive or steady state conditions created by a particular layout of water courses and junk slots.

BRIEF SUMMARY OF THE INVENTION

The present invention is an improvement in a rotating bit including at least one lobe defined by at least one channel also defined in the bit. The improvement comprises a jet nozzle defined in the bit to provide drilling fluid to the bit face. The jet nozzle is particularly characterized by disposition on the lobe. The jet nozzle includes an outlet orifice which is disposed on the lobe so that drilling fluid exiting the outlet orifice flows across the lobe. The lobe provides a substantially flush surface in the proximity around the orifice. By virtue of this disposition, drilling fluid is dispersed across the face of the lobe in a plurality of directions with a maximal velocity. The lobe also provides a directed flow of drilling fluid across the lobe by virtue of its inclination with respect to the longitudinal axis of the bit.

A source of drilling fluid is provided in the proximity of the nozzle so that drilling fluid ejected by the nozzle also entrains drilling fluid provided by the source thereby tending to draw the drilling fluid from the source into the flow of drilling fluid which is ejected by the nozzle. In the illustrated embodiment, the drilling fluid is a fluid filled channel which communicates with the proximity of the lobe wherein the jet nozzle is disposed. More specifically, the source is a fluid filled junk slot in the bit. Particularly, the bit includes a pilot bit and main reamer bit. The pilot bit is provided with drilling fluid and the junk slot is defined in the gage of the pilot bit. The drilling fluid which is provided to the pilot bit communicates with the pilot junk slot and thence is entrained within the flow of the drilling fluid ejected by the nozzle. By this combination of elements, drilling fluid provided to the pilot bit is suctioned from the face of the pilot bit.

BRIEF DESCRIPTION OF THE DRAWINGS

While the specification concludes with claims particularly pointing out and distinctly claiming the invention, it is believed that the invention, its objects, features and advantages will be better understood from the following description read in connection with the accompanying drawings. Consider now the following drawings wherein like elements are referenced by like numerals.

DETAILED DESCRIPTION OF THE PREFERRED EMBODIMENTS

The present invention is a rotating bit having a pilot portion and main bit portion wherein hydraulic nozzles are provided on the face of the pilot bit and on the face or reaming lobes of the main bit. The flow of drilling fluid is directed across the pilot bit to junk slots defined in the pilot bit to the proximity of nozzles disposed in the reaming lobes, which are positioned below certain ones of the pilot bit junk slots. Fluid emitted in a jet stream from the main bit nozzles entrains fluid from the pilot bit thereby increasing the velocity of the drilling fluid drawn or suctioned across and from the pilot bit. Moreover, the nozzles on the main bit are placed on or near the center of the reaming lobes so that fluid disperses across the reaming lobes to adjacent junk slots. In this manner, fluid is directed immediately toward the cutting elements. Fluid velocity is therefore maximal in the proximity of the cutting elements and minimal in the junk slots as opposed to prior art diamond bits wherein drilling fluid velocities are maximal in the water courses defined in the bit face.

Figure 1:
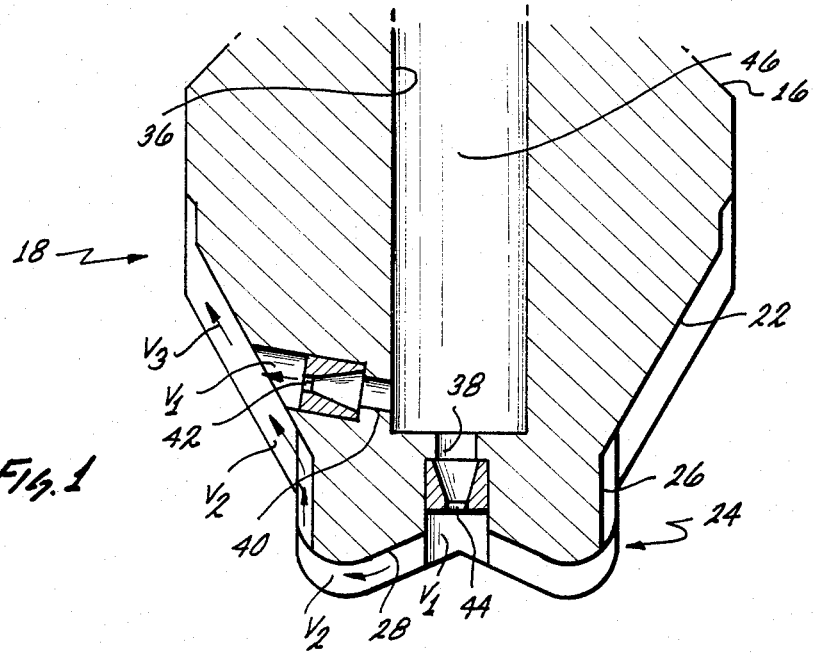
FIG. 1 is a cross sectional view of a rotating bit incorporating the invention as taken through line 1—1 of FIG. 2.
Figure 2:
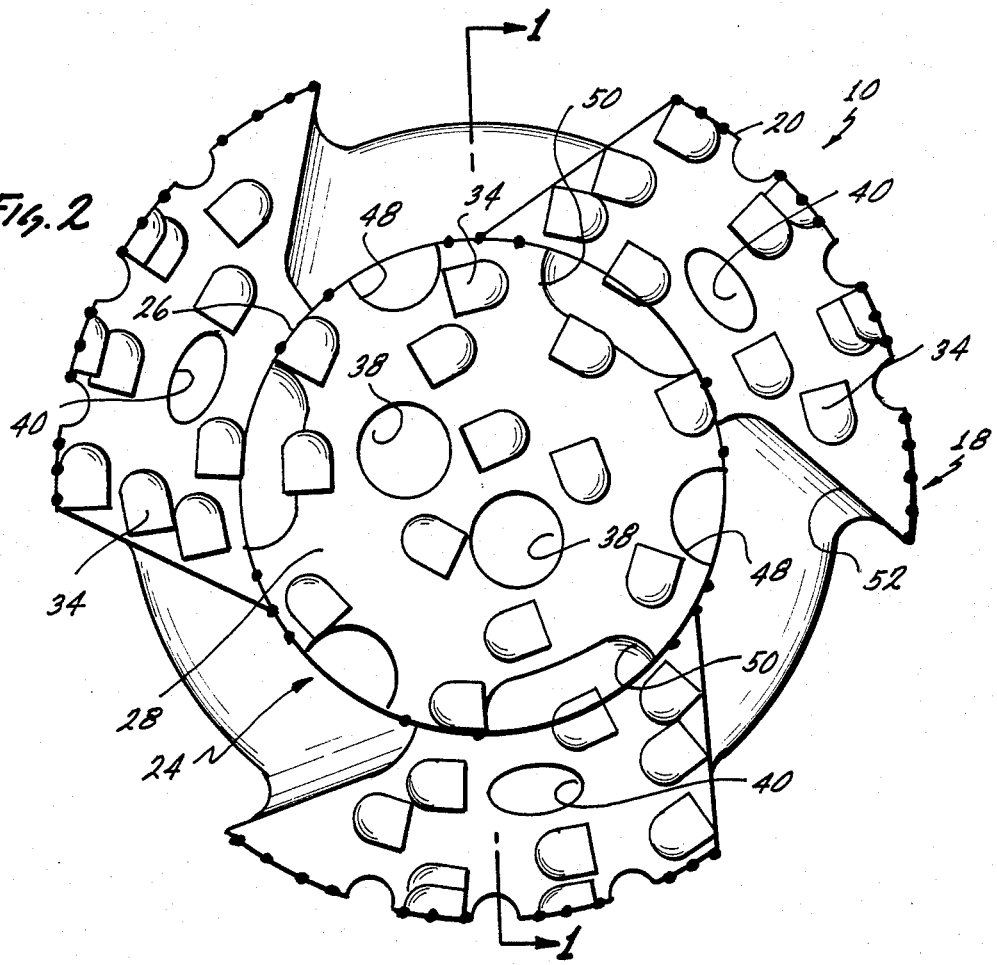
FIG. 2 is a plan view of the rotating bit of FIG. 1.

Turning now to FIG. 1, a diagrammatic cross-sectional view through line 1—1 of FIG. 2 is illustrated showing the profile of the rotating bit, generally denoted by reference numeral 10, and the position of nozzles 12 and 14 therein. Bit 10 includes a steel shank 16 only partially diagrammatically shown, and a main bit, generally denoted by reference numeral 18, including a main gage 20, reamer lobes 22 forming the flank of the main bit 18, and a pilot bit, generally denoted by reference numeral 24, including a pilot bit gage 26 and a pilot bit face 28. As better shown in connection with FIG. 3, main bit gage 20 and pilot bit gage 126 are provided with a plurality of surface set natural diamonds, namely kickers 30 and 32 respectively. Large, compact diamond cutters 34 are provided on reamer lobes 22 of main bit 18 and are similarly provided on face 28 of pilot bit 24. Such compact cutters include a cylindrical PCD table bonded to a metallic slug which in turn is disposed and brazed into pilot bit 24 or main bit 18. Such diamond cutters are manufactured by General Electric Company under the trademark "Stratapax".

Returning now to FIG. 1, bit 10 has axially defined therein a bore 36 which communicates with the axial bore also defined within the drill string to which bit 10 is mechanically coupled. Drilling mud is therefore forced through axial bore 36 in bit 10 to a plurality of nozzles which then selectively direct the drilling fluid to certain locations on bit 10 as described below. For example, considering in detail FIG. 1, axial bore 36 communicates with a pilot bit nozzle 38 and a reamer nozzle 40, both of which are shown in sectional view taken through line 1—1 of FIG. 2.

As most clearly illustrated in FIG. 2, two such pilot bit nozzles are provided in pilot bit 24 and three reamer nozzles are provided in main bit 18. Main bit 18 and pilot bit 24 are integrally manufactured by conventional powder metallurgical techniques using an infiltration process wherein nozzles 38 and 40 are molded into bit 10 together with axial bore 36. Drilling fluid is thus forced through bore 36 to nozzles 38 and 40 and is emitted from the outlet orifice 42 of nozzle 40 and outlet orifice 44 of pilot nozzle 38 with an approximately equal velocity, symbolically denoted as velocity V1. The velocities are determined according to ordinary design principles. Nozzles 38 and 40 are jet nozzles provided with a conical passageway communicating bore 36 with the outlet orifice. In the case of reamer nozzle 40, the longitudinal axis of nozzle 40 is directed upwardly of an angle to introduce a small vertical component in the direction of the longitudinal axis 46 of the bit 10 and to thereby set up an upwardly directed flow across the face of the bit 10. In the illustrated embodiment, longitudinal axis 46 of reamer nozzle 40 is inclined by approximately 10° with respect to the horizontal, which in turn is defined as perpendicular to longitudinal axis 46 of bit 10.

Turning now to FIG. 2, which illustrates a plan view of pilot bit 24 and main bit 18 showing the placement of nozzles, junk slots and cutting teeth. It should be specifically noted that each of the nozzles are disposed upon a planar surface of bit 10 and do not directly feed into a waterway as is typical with prior art diamond rotating bits. For example, pilot nozzles 38 are disposed at or near the center of pilot bit 24 and open directly onto pilot bit surface 28. Thus, drilling fluid exiting from pilot bit nozzles 38 disperses across pilot bit face 28 and moves radially in all directions toward pilot gage 26. However, pilot gage 26 is also provided with a plurality of pilot junk slots, namely a first type of junk slot 48 and a second type of junk slot 50. The first type of junk slot 48 is defined in pilot gage 26 and extends downwardly to main bit 18 where it is extended in a broadened main junk slot 52. The merger of first type of pilot junk slot 48 and main junk slot 52 is better illustrated in FIG. 3. The second type of pilot junk slot 50 is distinguished from the first type junk slot 48 by its greater breadth, that is its greater azimuthal opening, and by its disposition above and next to one of a plurality of reamer lobes 22 defined on the flank of main bit 18. In the embodiment illustrated in FIG. 2, three such reamer lobes 22 are defined in the flank of main bit 18 by the three alternating main junk slots 52.

Thus, when bit 10 is drilling, the drilled bore is shaped by the disposition of cutters on bit 10 so that the drilled bore provides little clearance to allow the escape of drilling fluid between pilot gage 26 and the drilled bore. Therefore, most of the drilling fluid from pilot nozzles 38 tends to move toward pilot junk slots 48 and 50 which define regions of lower pressure. As better shown in FIG. 1, the drilling fluid assumes a lower second velocity, V2, across face 28 of pilot bit 24.

Figure 3:
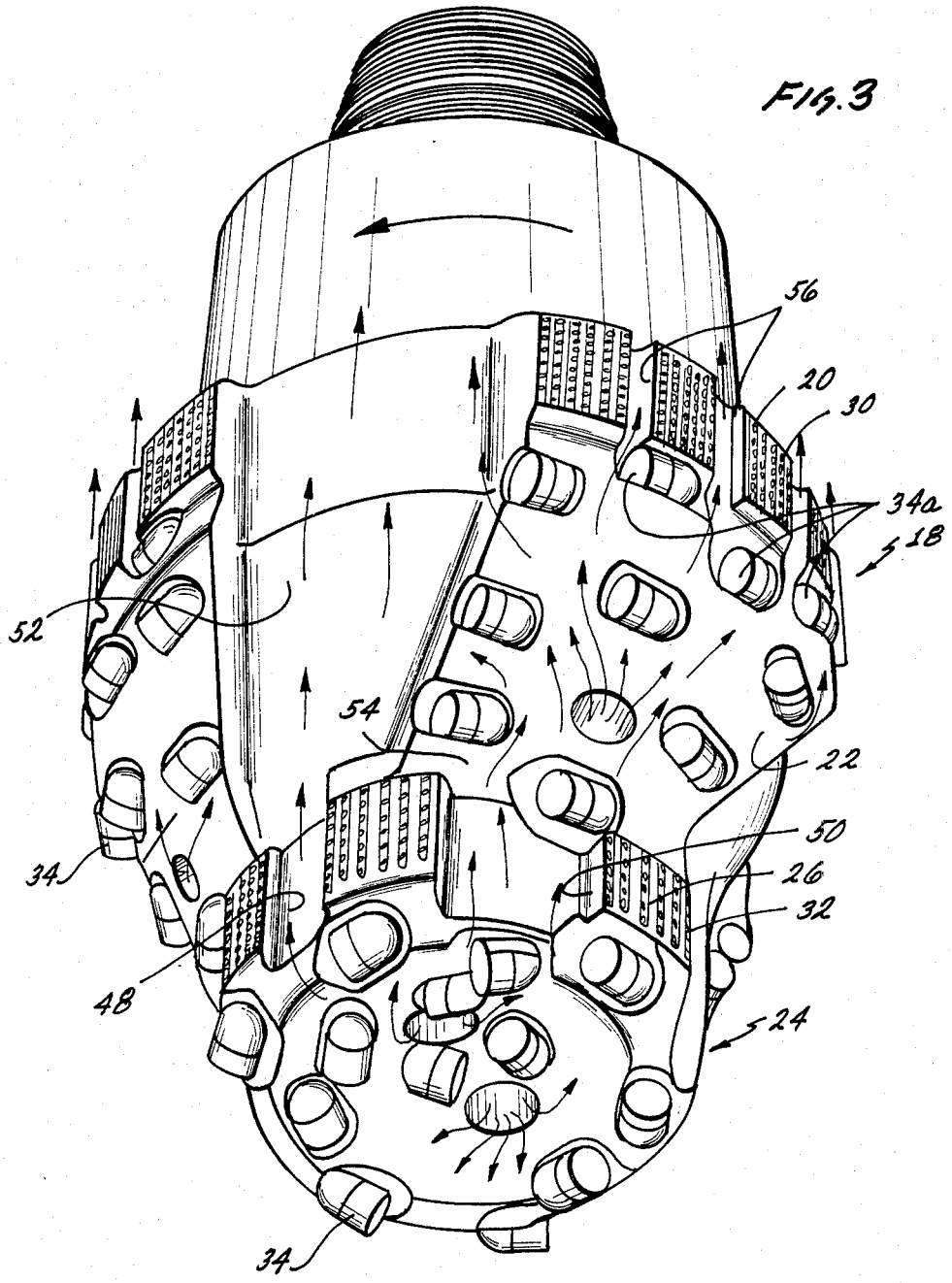
FIG. 3 is a pictorial perspective of the bit shown in FIGS. 1 and 2.

The primary flow of fluid, as indicated by directional arrows in FIG. 3 follows two types of paths. Firstly, fluid entering the first type of junk slot 48 communicates with main junk slot 52 and flows upward toward the drill string thereby providing a means for carrying large pieces of debris, junk, and chips out of the bore. The second path is defined by a second type of pilot junk slot 50 which then delivers fluid to the top center portion of reamer lobe 22 where the flank of reamer lobe 22 integrally connects with pilot gage 26 and second type of pilot junk slot 50. As previously stated, this portion of reamer lobe 22 will be fairly tightly disposed against the bore being drilled. However, reamer nozzle 40 is disposed just below the circumferential line 54 of annular connection between pilot bit 24 and main bit 18. The outlet of reamer nozzle 40 is flush with the upper surface of reamer lobe 22 and thereby provides drilling fluid through reamer nozzle 40 across the face of lobe 22 directed toward main gage 20 and adjacent main junk slots 52 on each side of reamer lobe 22. The velocity of drilling fluid exiting from reamer nozzle 40 is V1 which is significantly greater than the velocity of drilling fluid flowing down to line 54 through pilot junk slot 50. Because of the upward angular inclination of reamer nozzle 40, as described above, drilling fluid exiting from reamer nozzle 40 is generally directed toward main gage 20 and little or no drilling fluid injected by reamer nozzle 40 moves toward pilot gage 26. In fact, drilling fluid delivered by pilot junk slot 50 is entrained within the higher velocity flow of drilling fluid injected by reamer nozzle 40 and combines to comprise the fluid flow across reamer lobe 22. As a result, the velocity of drilling fluid delivered through junk slot 50 is increased to a velocity denoted as V3 which is less than the nozzle exit velocity but still greater than the velocity of the drilling fluid through junk slot 50. More succinctly stated, $V1 > V3 > V2$.

Therefore, reamer nozzle 40 by virtue of its disposition in the middle of reamer lobe 22 and its inclination, not only delivers drilling fluid in three directions across reamer lobe 22, namely, directly toward main gage 20 and to both adjacent main junk slots 52, but also serves in effect to draw or suction drilling fluid across and from bit face 28 of pilot bit 24.

Main gage 20 is also provided with a plurality of reamer junk slots 56 which serve as fluid sinks at the gage of reamer lobe 22 to facilitate the flow of drilling fluid toward the periphery of gage 20 below reamer lobe 22 directly below reamer nozzle 40. In the illustrated embodiment, reamer junk slots 56 may also be extended into reamer lobe 22 to communicate directly with the leading face of the radial most cutting elements 34*a*.

Many alterations and modifications may be made by those having ordinary skill in the art without departing from the spirit and scope of the present invention. For example, although the bit has been shown with Stratapax cutters, it is clearly contemplated that any other cutter now known or later devised may be employed with a bit incorporating the present invention. Further, although a bit incorporating a pilot bit and main reamer bit is particularly benefitted by incorporation of the invention, it is to be nevertheless understood that other bit designs distinct from that shown in the illustrated embodiment could also incorporate and utilize the present invention with advantage.

Therefore, the illustrated embodiment has been shown and described only for the purposes of example and clarification and should not be taken as limiting or restricting the scope of the invention as set forth in the following claims.

I claim:

1. An improvement in a rotating bit including a main bit body and a pilot bit extending therefrom characterized by a longitudinal axis, said improvement comprising:

a plurality of cutting elements disposed on said bit, wherein said main bit body includes a main gage and a plurality of reamer lobes extending from said main gage to said pilot bit, said plurality of elements being disposed on said pilot bit and on said plurality of reamer lobes;

at least one nozzle defined in said pilot bit; and at least one nozzle defined in each of said reamer lobes, said reamer and pilot nozzles for providing drilling fluid across said pilot bit and reamer lobes respectively, said plurality of reamer lobes being defined by junk slots between adjacent reamer lobes, and wherein said reamer nozzle is particularly characterized by disposition on said reamer lobe so that fluid exiting said reamer nozzle is distributed across said reamer lobe to said adjacent junk slots and gage, said reamer nozzle disposed at an upward acute angle with respect to said longitudinal axis, wherein said pilot bit includes a pilot gage and wherein said plurality of reamer lobes extend from said main gage of said main bit body to said pilot gage, said pilot gage including a plurality of pilot junk slots defined therein, and wherein said reamer nozzle is disposed on said reamer lobe in an azimuthally overlapping configuration with said pilot junk slots whereby fluid from said pilot nozzles flows across said pilot bit to said pilot junk slots and is therein entrained with fluid ejected from said reamer nozzles and flows in an accelerated manner across said main bit body.

2. An improvement in a rotating bit including at least one reamer lobe, and a pilot bit portion also defined in said bit characterized by a longitudinal axis, said pilot bit portion provided with drilling fluid from at least one orifice defined therein, a jet nozzle defined in said bit to provide drilling fluid to said bit face, said jet nozzle particularly characterized by disposition on said lobe, said jet nozzle including an outlet orifice disposed on said lobe so that drilling fluid exiting said outlet orifice flows across said lobe, said lobe providing a substantially flush surface in the proximity around said orifice, said jet nozzle disposed at an upward acute angle with respect to said longitudinal axis;

means defining a fluid filled channel communicating with the proximity of said lobe wherein said nozzle is disposed, said channel in fluidic communication with fluid flow across said pilot bit portion, and wherein said nozzle is disposed in the proximity of said channel so that drilling fluid ejected by said nozzle entrains drilling fluid provided by said channel thereby tending to draw said drilling fluid from said channel into the flow of drilling fluid ejected from said nozzle.

3. The improvement of claim 2 wherein said fluid filled channel is a junk slot defined in said bit.

4. A method for improving flow of a drilling fluid across a rotating bit having a a pilot bit and reamer comprising the steps of:

providing drilling fluid to said face of said pilot bit, said drilling fluid flowing across said face of said pilot bit in a generally radial direction to establish a first flow pattern of said drilling fluid on said pilot bit, said first fluid flow pattern is established across a pilot bit and in particular along junk slots defined in the gage of said pilot bit; and directionally injecting drilling fluid across the flank of a main reamer bit disposed adjacent to said pilot bit at a selected point in relation to said first fluid flow pattern in said junk slots defined in the gage of said pilot bit to increase velocity of said drilling fluid across the face of said pilot bit and to establish a second fluid flow pattern across said reamer, whereby cooling and cleaning efficiencies can be improved and whereby said second fluid flow pattern serves in part to suction said drilling fluid across said first fluid flow pattern.

5. The method of claim 4 wherein said second fluid flow pattern is established by a jet nozzle disposed on said bit, said jet nozzle injecting said drilling fluid across the face of said bit in a preferential direction.

6. The method of claim 5 wherein velocity of said drilling fluid in said second fluid flow pattern is greater than velocity of said drilling fluid in said first fluid flow pattern at the point where said drilling fluid is injected by said nozzle to establish said second fluid flow pattern.

* * * * *